United States Patent [19]

Takahashi

[11] 3,994,667

[45] Nov. 30, 1976

[54] GAS FUELED LIGHTER

[75] Inventor: Hideo Takahashi, Funabashi, Japan

[73] Assignee: Hadson Trading Company Limited, Tokyo, Japan

[22] Filed: Dec. 5, 1975

[21] Appl. No.: 638,085

[30] Foreign Application Priority Data

Mar. 18, 1975 Japan ..... 50-35499
Mar. 18, 1975 Japan ..... 50-34500
Mar. 18, 1975 Japan ..... 50-34501

[52] U.S. Cl. ..... 431/131
[51] Int. Cl.[2] ..... F23Q 2/08
[58] Field of Search ..... 431/129, 130, 131, 135, 431/136, 137, 138, 139, 140, 141

[56] References Cited

UNITED STATES PATENTS

| | | | |
|---|---|---|---|
| 3,561,897 | 2/1971 | Hocq | 431/130 |
| 3,592,576 | 7/1971 | Hocq | 431/131 |
| 3,734,680 | 5/1973 | Maruyama | 431/132 |

*Primary Examiner*—Edward G. Favors
*Attorney, Agent, or Firm*—Holman & Stern

[57] ABSTRACT

A gas fueled lighter wherein a cam member is rotated in response to the vertical opening and closing movements of the cover and the rotational movement of the cam member in a vertical plane is converted into the rotational movement of a bearing member holding a knurled sparking wheel in a horizontal plane to thereby allow the sparking wheel to smoothly project from and recede into a lighter casing, and a sparking mechanism and a burner valve opening and closing mechanism are combined into one block and mounted as such in the casing thereby simplifying the assembling as well as the disassemblying of the lighter for repair purposes.

7 Claims, 4 Drawing Figures

GAS FUELED LIGHTER

BACKGROUND OF THE INVENTION

A known type of gas fueled lighter is designed so that when the lighter is not in use, the knurled sparking wheel is retracted and located in place in the lighter casing, whereas when the cover is opened for lighting a cigarette or the like, the knurled sparking wheel is projected partly from the lighter casing in response to the opening of the cover thus permitting the sparking wheel to be easily rotated by the operator's thumb. A disadvantage of this type of gas fueled lighter is that the lighter employs for the most part a gear train for operatively connecting the knurled sparking wheel with the cover, thus making the lighter complicated in construction, expensive to manufacture and difficult to disassemble for repair. Moreover, the entry of dirt and dust, particularly the rubbed-off dust of the flint into the gear train tends to cause problems in the lighter.

In another known type of gas fueled lighter, a very long flint holding tube is used whose lower end reaches the bottom end of the lighter and whose upper portion extends to the upper portion of the lighter through the fuel tank. This type of lighter also has disadvantages in that such a flint holding tube usually consists of a single long tube. The use of such a long continuous tube is disadvantageous from the standpoints of manufacturing cost, process, etc. Moreover, in order to mount a block fitted with the required spark generating mechanism on the upper portion of the fuel tank, it is necessary to form a flint holding tube receiving hole and align the hole in the block with the flint holding tube when mounting the block in place thus requiring a complicated assembling operation. Another disadvantage is that it is practically impossible to utilize such flint holding tube for the mounting of other mechanisms or make the flint holding tube to serve other purposes.

SUMMARY OF THE INVENTION

The present invention has been developed for the purpose of overcoming the foregoing deficiencies of the conventional gas fueled lighters, and it is therefore an object of the present invention to provide a gas fueled lighter having an improved knurled sparking wheel driving mechanism. More particularly, it is an object of the invention to provide a gas fueled lighter of the type in which the knurled sparking wheel is retracted and located in place in the lighter casing when the lighter is not in use and the knurled sparking wheel is moved to partially project from the lighter casing for easy rotation by the operator's thumb in response to the movement of the cover when the latter is opened for lighting a cigarette or the like, having an improved knurled sparking wheel driving mechanism which easily and positively relates the operation of the cover with that of the knurled sparking wheel and which also permits the burner valve to open in response to the operation of the former.

It is another object of the invention to provide such a gas fueled lighter wherein a spark generating mechanism including the knurled sparking wheel driving mechanism and a burner valve opening and closing mechanism are combined into one block which may be very easily and accurately mounted in place in the lighter.

It is still another object of the invention to provide such a gas fueled lighter wherein in addition to the principal parts being combined into one block, the remaining items which are not incorporated in the block, particularly the flint holding tube, are improved so that the longitudinally extended lengthy flint holding tube is divided two parts which may be combined into the unitary flint holding tube by simply inserting one into another.

The above and other objects, features and advantages of the invention will become readily apparent from the detailed description of a specific embodiment when read in conjunction with the accompanying drawings.

DESCRIPTION OF THE PREFERRED EMBODIMENT

Figure 1:
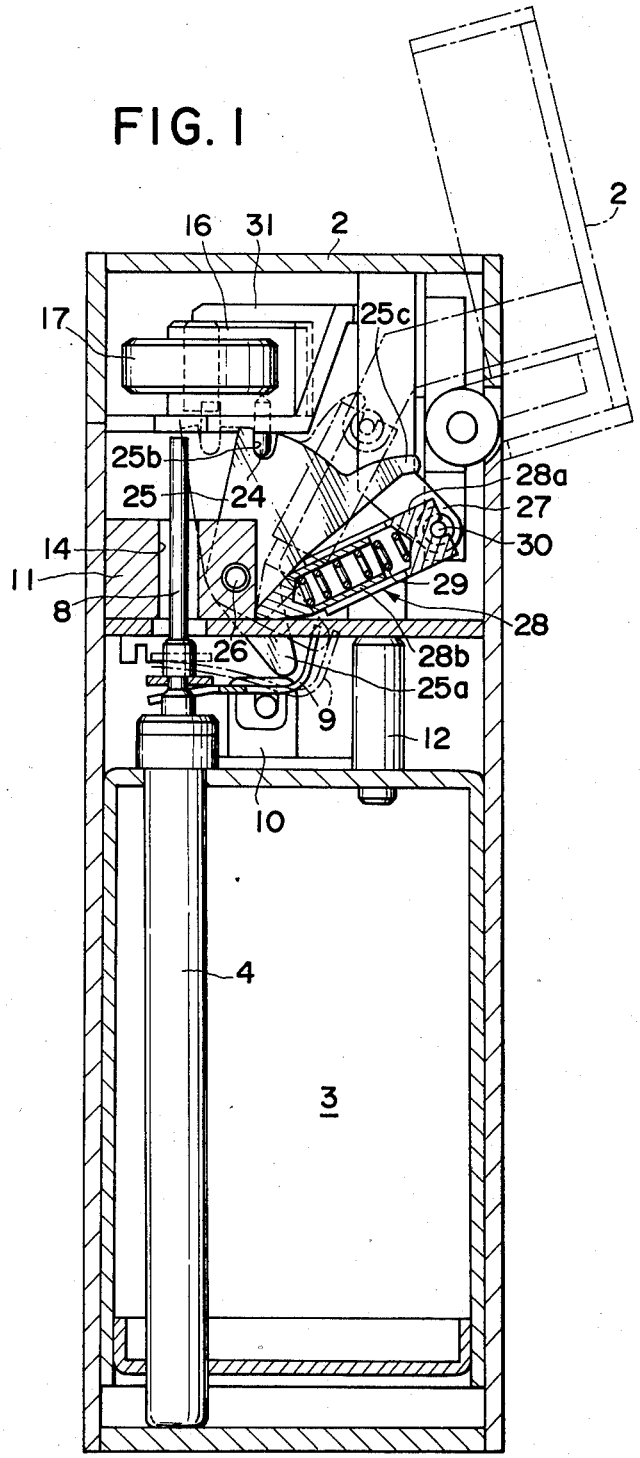
FIG. 1 is a longitudinal sectional view taken along the line A—A of FIG. 4.

Referring to the drawings, a longitudinally elongated lighter casing having an oval crosssectional shape is designated by the reference numeral 1. The lighter casing 1 has a closed lower end and an opened upper end. A cover 2 is upwardly openably hinged to one side of the upper portion of the casing 1.

Mounted inside the lighter casing 1 is a fuel reservoir 3 which is capable of storing fuel gas in liquid form under pressure. The fuel reservoir 3 is provided with a filling valve mechanism for feeding fuel gas into the fuel reservoir 3 and a burner valve mechanism through which the fuel gas is discharged for ignition. In the illustrated embodiment, these mechanisms are provided in the form of a unitary valve system 4 whose upper portion constitutes the burner valve mechanism and whose lower portion constitutes the filling valve mechanism. The valve system 4 is further provided with a flow regulating mechanism by which the flow rate of the fuel gas discharged through the burner valve mechanism can be adjusted at the lower portion of the lighter.

Figure 2:
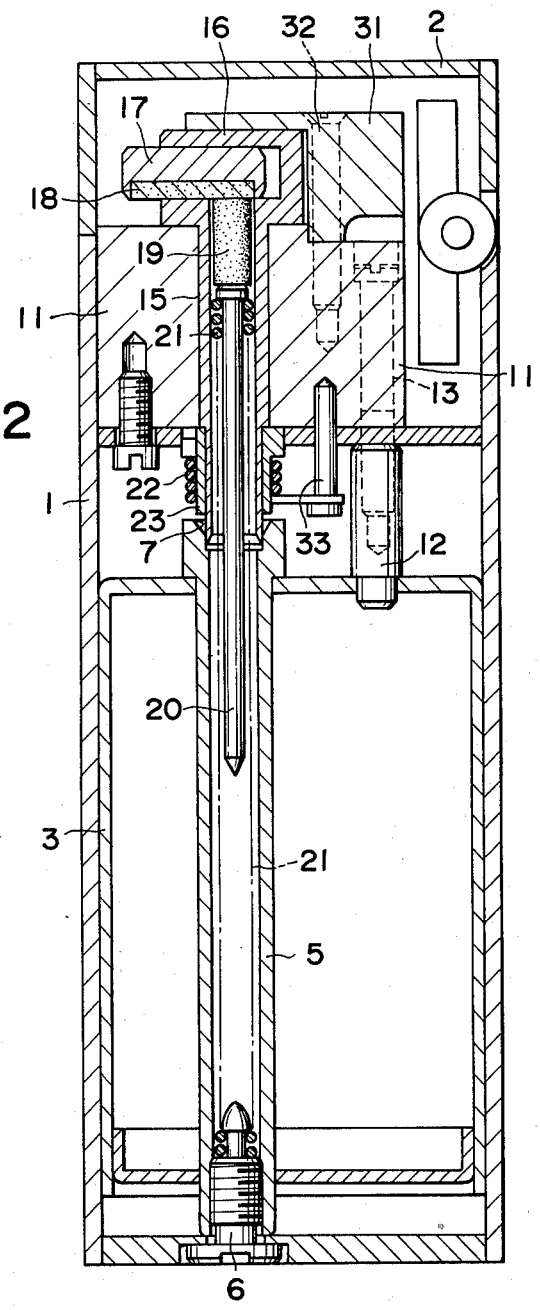
FIG. 2 is a longitudinal sectional view taken along the line B—B of FIG. 4.
Figure 3:
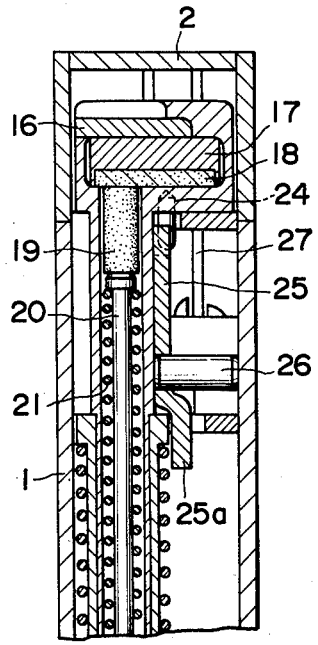
FIG. 3 is a partial longitudinal sectional view taken along the line C—C of FIG. 4.
Figure 4:
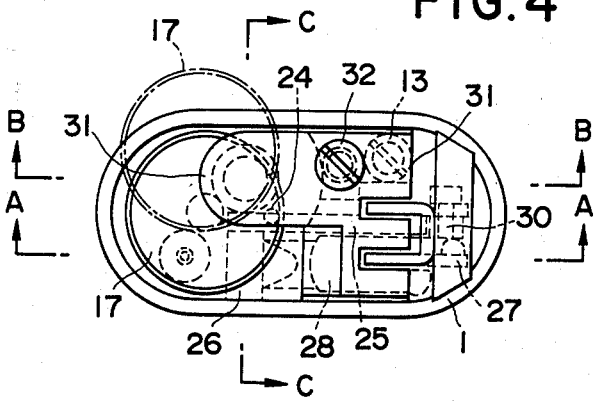
FIG. 4 is a plan view of a gas fueled lighter according to an embodiment of the invention, with the cover taken away.

In the fuel reservoir 3, a lower flint holding tube 5 having open ends and constituting part of the holding tube for receiving the flint, is positioned along a longitudinal axis which is different from that of the valve system 4 (FIG. 2). The lower flint holding tube 5 is vertically extended through the reservoir 3 and is provided at its lower portion with a removably threadedly fitted flint urging screw 6 and its upper portion with a socket 7 which is adapted for connection with an upper flint holding tube 15 that will be described later. The base of a nozzle 8 constituting the upper portion of the burner valve mechanism engages with the forward end of a valve opening and closing lever 9 which is pivotably supported at its substantially central portion on a bearing plate 10 mounted on the upper surface of the reservoir 3 to serve as a fulcrum (FIG. 1). Thus, when the rear end of the lever 9 is depressed, the nozzle 8 is lifted to open the burner valve mechanism.

Disposed above the reservoir 3 is a block 11 on which the spark generating mechanism is arranged and supported. The block 11 is mounted on a fitting pipe 12 which is projected from the upper surface of the reservoir 3. The block 11 is secured in place by a locking bolt 13 which is threadedly fitted in the fitting pipe 12 through the upper surface of the block 11. Since the block 11, which has been preliminarily equipped with the spark generating mechanism in the manner described later, is fixedly mounted in the lighter casing, this considerably simplifies the assembling of the lighter. A feature of this invention resides in this point. The upper surface of the block 11 is positioned to stick out slightly above the upper end of the lighter casing 1 to permit the movement of the knurled sparking wheel.

A nozzle hole 14 for receiving the nozzle 8 is formed in the block 11 in alignment with the axis of the valve system 4 and the nozzle hole 14 opens at the upper surface of the block 11. The block 11 also rotatably holds therein the upper flint holding tube 15 which is connected to the lower flint holding tube 5. When the block 11 is mounted on and held in place by the fitting pipe 12, the lower end of the upper flint holding tube 15 is fitted into the upper socket 7 of the lower flint holding tube 5 thus connecting the bores of the upper and lower tubes 5 and 15 along the same axis. This is another feature of the invention. Thus, by virtue of the fact that the flint holding tube is divided into the upper and lower portions 5 and 15, the lower flint holding tube 5 is vertically fixedly inserted through the fuel reservoir 3, the upper portion of the lower flint holding tube 5 is formed into the socket 7 having a cone-shaped opening to readily receive the tube 15, and the upper flint holding tube 15 is fitted in the block 11 having the required spark generating mechanism provided therewith, there is no need to use a single lengthy tubular material with a resultant reduction in the manufacturing cost. Moreover, the fact that the upper and lower portions 5 and 15 are separately fitted in the fuel reservoir 3 and the block 11 has the effect of simplifying the mounting of the flint holding tube and making the assembling of the lighter easier.

A bearing member 16 for supporting the knurled sparking wheel 17 is integrally formed in the upper portion of the upper flint holding tube 15. Consequently, the upper flint holding tube 15 serves as a bearing for the knurled sparking wheel 17. The bearing member 16 is a circular member having a C-shaped crosssectional shape in its central portion for laterally receiving the knurled sparking wheel 17. The knurled sparking wheel 17 is horizontally rotatably mounted at a position which is eccentric with the axis of rotation of the upper flint holding tube 15. In this mounted condition, the knurled sparking wheel 17 is partially projected laterally from the bearing member 16, and the rotational movement of the bearing member 16 together with the upper flint holding tube 15 causes the knurled sparking wheel 17 to partially project from the lighter casing 1 into a position where it can be rotated by the operator's thumb.

Fitted in the lower surface of the knurled sparking wheel 17 is a disk-shaped sparking member 18 against which is urged a flint 19 projected from the upper flint holding tube 15. The flint 19 is pressed against the sparking member 18 by the force of a spring 21 provided between a flint urging rod 20 and the flint urging screw 6, so that the sparks required for igniting the gas are produced by rotating the knurled sparking wheel 17 by the operator's thumb.

A return spring 22 is mounted on the portion of the upper flint holding tube 15 which is downwardly projected from the block 11 so that the bearing member 16 is rotated together with the knurled sparking wheel 17 to normally bias the knurled sparking wheel 17 into a retracted position within the lighter casing 1. As shown in the drawings, the return spring 22 is stretched between a short tube 23 mounted on the upper flint holding tube 15 and a pin 33 which is dependent from the block 11. In this way, the spark generating mechanism including the upper flint holding tube 15 and the knurled sparking wheel 17 can be preliminarily fitted with the block 11 before the block 11 is assembled in the lighter and moreover the assembling operation is simplified considerably by virtue of the novel flint holding tube consisting of the upper and lower portions 5 and 15 that can be united by simply inserting one into another in the above-mentioned manner.

An actuating pin 24 is fitted in the lower surface of the bearing member 16 at a position which is eccentric with the axis of rotation of the bearing member 16 and which is different from the position of the shaft of the knurled sparking wheel 17. As a result, when the actuating pin 24 is urged in a horizontal plane, the bearing member 16 is rotated and thus the knurled sparking wheel 17 is rotated to partially project from the lighter casing 1 in the manner mentioned earlier.

Reference numeral 25 designates an actuating cam pivoted by a pin 26 to the block 11 to be rotatable in a vertical plane. The actuating cam 25 is provided at its lower portion with a projection **25*a* which is adapted to strike and depress the free end of the lever 9, at its upper portion with a cutout recess 25*b* for receiving the actuating pin 24 and on its side with an actuating projection 25*c* against which is struck a portion of cover opening and closing means when the cover 2 is swung. The provision of the actuating cam 25 is very important for the present invention and pin 24 is always received in the cutout recess 25*b* so that the cam 25 and pin 24** are not permitted to disengage each other.

Fixedly attached to the lower end of the cover 2 is an operating arm 27 which bears one end of a cover opening and closing means 28. The cover opening and closing means 28 includes a pair of cylinders **28*a* and 28*b* and a spring 29 mounted inside the cylinders 28*a* and 28*b*. The cylinder 28*a* is rotatably mounted on a pivot shaft 30 of the arm 27 and the other cylinder 28*b* has its conical forward end pivotably secured to a suitable position on the block 11. Consequently, the actuating projection 25*c* of the actuating cam 25 is adapted to strike against the pivot shaft 30 of the arm 27.**

Designated by the reference numeral 31 is a cover for covering the upper surface of the block 11 including the bearing member 16 and it is fixed in place by a fastening screw 32. The cover 31 is assembled in place after the block 11 has been fixedly mounted in place in the lighter casing 1.

In operation, when the cover 2 is opened upward for igniting the gas, the pivot shaft 30 is moved to the position shown by the phantom line in FIG. 1 and, during its movement the pivot shaft 30 strikes against the actuating projection **25*c* of the actuating cam 25 thus pressing the actuating cam 25. Consequently, the actuating cam 25 is rotated about the pin 26** in the vertical plane and this rotational movement brings about the following two operations simultaneously.

Namely, in the first place, the bearing member 16 is rotated in the horizontal plane about the upper flint holding tube 15 through the intermediary of the actuating pin 24 received in the cutout recess 25*b*. In this case, since the actuating cam 25 has a certain thickness and the cutout recess 25*b* has a length corresponding to the thickness of the actuating cam 25, the actuating pin 24 is slightly moved in the cutout recess 25*b* in a direction which makes a right angle with the direction of movement of the actuating cam 25 but it is not allowed to come out of engagement with the cutout recess 25*b*. Of course, the rotational movement of each of these two elements is not so large and this fact also explains how the actuating pin 24 is prevented from disengaging with the cutout recess 25*b* in the actuating cam 25. In this way, the rotation of the actuating cam 25 in the vertical plane is converted through the actuating pin 24 into the rotation of the bearing member 16 in the horizontal plane, so that the bearing member 16 is rotated against the tension of the return spring 22 and the knurled sparking wheel 17 is partially projected from the lighter casing 1.

In addition to the above-described function, the actuating cam 25 performs the following function. Namely, its projection 25*a* urges one end of the lever 9 downward so that the other end of the lever 9 raises the nozzle 8 to open the burner valve. Consequently, when the knurled sparking wheel 17 is rotated by the operator's thumb, the sparking member 18 is rubbed against the flint 19 which is pressed against the lower surface of the former, thus producing sparks and igniting the fuel gas discharged through the nozzle 8.

When the cover 2 is closed to extinguish the fire, the movement of the cover 2 brings the pivot shaft 30 back into the original position and the urging force acting on the actuating cam 25 is removed. As a result, the upper flint holding tube 15 is rotated by the tension of the return spring 22 mounted on the upper flint holding tube 15 and the bearing member 16 is thereby rotated to retract the knurled sparking wheel 17 into the lighter casing 1. Simultaneously, the urging pressure acting on the lever 9 is removed, and the nozzle 8 is lowered to stop the discharge of the fuel gas.

It will thus be seen from the foregoing description that the gas fueled lighter provided in accordance with the present invention, by virtue of its novel features, namely, the bearing member 16, which is provided with the knurled sparking wheel 17 rotatable about the shaft located eccentric with the axis of rotation of the bearing member 16, being mounted in the lighter casing 1 to be rotatable in the horizontal plane so that the rotation of the bearing member 16 in the horizontal plane causes the knurled sparking wheel 17 to be partially projected from the lighter casing 1 for rotation with the operator's thumb, the actuating cam 25 which is operable in response to the opening and closing of the cover 2 being rotatably mounted on the pin in the lighter casing 1, the actuating cam 25 and the bearing member 16 being interconnected through the actuating pin 24 attached to the bearing member 16 at a position eccentric with the axis of rotation of the bearing member 16, the lever 9 for opening the burner valve mechanism being adapted to be depressed downward by the portion of the actuating cam 25 and the knurled sparking wheel 17 being adapted to be partially projected from the lighter casing 1 in response to the rotation of the cam 25, eliminates such disadvantages as encountered in the conventional lighters of the type using gear train mechanisms, for example, the complexity of the construction and the tendency of causing troubles due to the entry of foreign matter between the gears of the gear train, and has advantages such as the simplified construction, easy assembling operation, practically no possibility of occurrence of problems and stable operation.

Further, by virtue of another novel feature, wherein the block 11, provided with the knurled sparking wheel 17 and the burner valve mechanism, being mounted on the fitting pipe 12 projected from the upper surface of the fuel reservoir 3, the locking bolt 13 being inserted through the upper portion of the block 11 and threadedly fitted in the fitting pipe 12 to fixedly mount the block 11 in place, the flint holding tube being divided into two parts, i.e., the lower flint holding tube 5 fixedly mounted in the fuel reservoir 3 and the upper flint holding tube 15 fitted in the block 11, and the lower end of the upper flint holding tube 15 being adapted to be inserted in the cone-shaped opening of the socket 7 on the upper end of the lower flint holding tube 5 to join the upper and lower tubes together, the assembling of the lighter can be completed in effect by simply fitting the spark generating mechanism and the burner valve opening and closing mechanism on the block and then inserting and screwing the thus assembled block in place in the lighter casing by means of the locking bolt 13. Thus the assembling of the lighter is simplified considerably.

Having described my invention, what I claim as new and desire to secure by Letters Patent is:

1. A gas fueled lighter comprising:

a casing having an upper portion;

a cover hingedly mounted on one side of the upper portion of said casing and adapted to be opened upwardly;

a fuel reservoir disposed within said casing;

a burner valve operatively associated with said reservoir;

a burner valve opening and closing means for opening and closing said burner valve;

a spark generating means for generating a spark;

a connecting means for operatively associating said burner valve opening and closing means with the movement of said cover and for moving said spark generating means into and out of position;

wherein:

a. said spark generating means comprises:

a block member having an upper surface;

a bearing member rotatably mounted in said block member having a central axis, an upper portion and a lower portion;

a shaft fixed in said upper portion of said bearing member parallel to and eccentric from said central axis, a knurled sparking wheel rotatably mounted on said shaft, an upper flint holding tube forming the lower portion of said bearing member and extending through said block member, and a return spring mounted on and rotationally biasing said upper flint holding tube such that said sparking wheel is tensionally held within said casing;

b. said burner valve opening and closing means comprises a pivotedly mounted lever operating said burner valve; and c. said connecting means comprises:

an actuating pin mounted on said bearing member at a position eccentric with said central axis; and an actuating cam pivotedly mounted on said block member rotationally associated with said cover, said actuating cam having first portions moving said actuating pin when said cover is opened thereby rotating said bearing member to partially projects said sparking wheel beyond said casing against the bias of said return spring, said return spring rotating said bearing member such that said sparking wheel is returned to within said casing when said cover is closed, and said actuating cam having second portions operating said lever to open said burner valve when said cover is open and to close said burner valve when said cover is closed.

2. The lighter according to claim 1 wherein said spark generating means further comprises a lower flint holding tube having an upper portion and a lower portion, said lower portion vertically extending through and fixed secured in said reservoir and said tube upper portion forming a cone-shaped socket; and said upper flint holding tube being adapted to be removably fitted into said socket.

3. The lighter according to claim 1 wherein said connecting means further comprises:

an operating arm pivotedly fixed on one end to said cover and pivotedly mounted on a pivot shaft at its other end, and a biasing means attached to said pivot shaft and wherein said pivot shaft strikes against and rotates said actuating cam when said cover is opened.

4. The lighter according to claim 1, further comprising:

a locking bolt inserted through said block member to fasten said block member to said reservoir;

a cover member covering said upper surface of said block member; and a fastening screw attaching said cover member to said block member.

5. The lighter according to claim 1 further comprising;

a locking bolt inserted through said block member to fasten said block member to said reservoir;

a cover member covering said upper surface of said block member; and a fastening screw attaching said cover member to said block member; and wherein said spark generating means further comprises:

a lower flint holding tube having an upper portion vertically extending through and fixed secured in said reservoir and said tube upper portion forming a cone-shaped socket and said flint holding tube being adapted to be removably fitted into said socket; said connecting means further comprises:

an operating arm pivotedly fixed at one end to said cover and pivotedly mounted on a pivot shaft at its other end;

a biasing means attached to said pivot shaft;

said actuating cam having a projection which is struck by said pivot shaft when said cover is opened thereby rotating said actuating cam, said second portion being an actuating projection adapted for abutting engagement with one end of said lever having the other end thereof engaged with said burner valve, and said actuating cam first portion being a cutout recess constantly receiving said actuating pin eccentrically mounted on the lower portion of said bearing member, said actuating cam making in a vertical plane a rotational movement about the portion thereof which is pivoted to said block member and said bearing member being adapted to convert said rotational movement of said actuating cam into its rotational movement in a horizontal plane to thereby rotate and project said sparking wheel partly from said casing.

6. The lighter according to claim 1 wherein said bearing member, with said eccentrically supported knurled sparking wheel, is adapted to be rotatably inserted into said block member through the intermediary of said upper flint holding tube which is integral with the lower portion of said bearing member during the assembling of said lighter.

7. The lighter according to claim 3, wherein said actuating cam second portion being a projection adapted for abutting engagement with said pivot shaft, said actuating cam having an actuating projection adapted for abutting engagement with one end of said lever having the other end thereof engaged with said burner valve, and said first portion being a cutout recess constantly receiving said actuating pin eccentrically mounted on the lower portion of said bearing member, said actuating cam making in a vertical plane a rotational movement about the portion thereof which is pivoted to said block member, and said bearing member being adapted to convert said rotational movement of said actuating cam into its rotational movement in a horizontal plane to thereby rotate and project said knurled sparking wheel partly from said lighter casing.

* * * * *